US008550180B2

(12) United States Patent
Kahra

(10) Patent No.: US 8,550,180 B2
(45) Date of Patent: Oct. 8, 2013

(54) BEARING OF A BREAKING DEVICE TOOL

(75) Inventor: Ossi Kahra, Nastola (FI)

(73) Assignee: Sandvik Mining and Construction Oy, Tampere (FI)

( * ) Notice: Subject to any disclaimer, the term of this patent is extended or adjusted under 35 U.S.C. 154(b) by 138 days.

(21) Appl. No.: 11/987,667

(22) Filed: Dec. 3, 2007

(65) Prior Publication Data

US 2008/0173457 A1 Jul. 24, 2008

(30) Foreign Application Priority Data

Dec. 5, 2006 (FI) ..... 20065775

(51) Int. Cl.
*B25D 17/08* (2006.01)

(52) U.S. Cl.
USPC ..... 173/210; 173/31

(58) Field of Classification Search
USPC ..... 173/31, 128, 132, 210; 384/125, 140, 384/215
See application file for complete search history.

(56) References Cited

U.S. PATENT DOCUMENTS

| | | | | | |
|---|---|---|---|---|---|
| 2,512,149 | A | * | 6/1950 | Gartin | 279/19.5 |
| 3,917,361 | A | * | 11/1975 | Murdoch | 384/92 |
| 3,929,392 | A | * | 12/1975 | Ogino | 384/215 |
| 4,284,148 | A | * | 8/1981 | Wanner et al. | 173/109 |
| 4,895,212 | A | * | 1/1990 | Wache | 173/48 |
| 5,199,508 | A | * | 4/1993 | Miyanaga | 173/211 |
| 5,388,842 | A | * | 2/1995 | Piras et al. | 279/19.5 |
| 5,755,294 | A | * | 5/1998 | Lee | 173/210 |
| 5,839,517 | A | * | 11/1998 | Gwinn et al. | 173/162.2 |
| 5,944,120 | A | * | 8/1999 | Barden | 173/212 |
| 5,971,403 | A | * | 10/1999 | Yahagi et al. | 279/19.3 |
| 6,186,246 | B1 | * | 2/2001 | Muuttonen et al. | 173/1 |
| 6,510,904 | B1 | | 1/2003 | Tyrrell | |
| 6,561,285 | B2 | * | 5/2003 | Intonen et al. | 173/211 |
| 6,679,411 | B2 | * | 1/2004 | Popovich et al. | 227/10 |
| 7,152,692 | B2 | * | 12/2006 | Hurskainen et al. | 173/16 |

(Continued)

FOREIGN PATENT DOCUMENTS

| | | |
|---|---|---|
| DE | 295 10 818 U1 | 9/1995 |
| JP | 2-39889 | 3/1990 |
| JP | 2-93110 | 4/1990 |

(Continued)

OTHER PUBLICATIONS

European Search Report mailed Apr. 22, 2008 issued in European Application No. 07 12 1945.
Notification of Reason for Refusal (and translation) for JP2007-314835, dated Oct. 30, 2012.

*Primary Examiner* — Hemant M Desai
*Assistant Examiner* — Gloria R Weeks
(74) *Attorney, Agent, or Firm* — Morgan, Lewis & Bockius LLP

(57) ABSTRACT

The invention relates to a method for fitting a breaking device tool with a bearing, a breaking device and a tool bushing. The tool of the breaking device is fitted with a bearing with at least one bearing bushing manufactured of bearing material and arranged in a bearing space. There is a clearance fit between the bearing bushing and the bearing space, whereby the bearing bushing is insertable into the bearing space by manual force. During the use, compression stress pulses are given to the tool with a percussion device, whereby stress waves travel in the tool, which waves generate on the tool surface a movement in the direction of its perpendicular. This movement is transmitted to the bearing bushing, and it deforms the bearing bushing in the radial direction in such a way that the bearing bushing is pressed against the bearing space.

22 Claims, 5 Drawing Sheets

(56) References Cited

U.S. PATENT DOCUMENTS

| | | | | |
|---|---|---|---|---|
| 7,284,622 | B2 * | 10/2007 | Hahn | 173/132 |
| 7,438,139 | B2 * | 10/2008 | Pillers, II | 173/132 |
| 7,469,753 | B2 * | 12/2008 | Klemm et al. | 173/178 |
| 2005/0274534 | A1 | 12/2005 | Goetzfried et al. | |

FOREIGN PATENT DOCUMENTS

| | | |
|---|---|---|
| JP | 8-37751 | 2/1996 |
| JP | 8-281570 | 10/1996 |
| JP | 2005-155655 | 6/2005 |
| WO | 00/58058 | 10/2000 |

* cited by examiner

BEARING OF A BREAKING DEVICE TOOL

RELATED APPLICATION DATA

This application claims priority under 35 U.S.C. §119 and/or §365 to Finish Application No. 20065775, filed in Finland on Dec. 5, 2006, the entire contents of which are incorporated herein by reference.

BACKGROUND OF THE INVENTION

The invention relates to a method for fitting a breaking device tool with a bearing, a breaking device and a tool bushing used for a bearing. The breaking device comprises at least a frame, a tool and a percussion device. By means of a percussion element in the percussion device, compression stress pulses are generated in the tool, which transmits them further to material to be broken. In a bearing space around the tool a bearing bushing is arranged, a sliding surface on the inner periphery of the bearing bushing fitting the tool with a bearing to be movable in the axial direction of the tool. The object of the invention is described in more detail in the preambles of the independent claims.

A breaking hammer is a breaking device used as a supplementary device of an excavator or another basic machine when the intention is to break for instance rock, concrete or other relatively hard material. The percussion device of the breaking hammer is used to give compression stress pulses to a tool attached to the breaking hammer, the tool transmitting the stress pulses to the material to be broken. At the same time, the tool is pressed against the material to be broken, whereby the effect of the stress waves and pressing causes the tool to penetrate into the material to be broken, which results in breaking of the material. The tool of the breaking device is mounted on a bearing in the frame of the breaking device in such a way that it can move in the axial direction during the breaking. The tool is usually mounted on a slide bearing by means of one or more bearing bushings. In known solutions, the bearing bushing is attached to a tool bushing that is, in turn, attached to the frame of the breaking device. The bearing bushing is a slide bearing that wears in use, due to which it has to be changed from time to time. A problem with known solutions is that it is difficult and slow to change a worn bearing bushing in working site conditions.

BRIEF DESCRIPTION OF THE INVENTION

An object of this invention is to provide a novel and an improved method for fitting a breaking device tool with a bearing, a breaking device and a tool bushing.

The method according to the invention is characterized by arranging a clearance fit between the outer diameter of the bearing bushing and the diameter of the bearing space; inserting the bearing bushing in the axial direction to its place in the bearing space without a force effect resulting from the reciprocal dimensioning of the diameters of the bearing bushing and the bearing space; and locking the bearing bushing during the use of the breaking device in the axial direction to be substantially immovable in such a way that the tool is subjected to compression stress pulses, whereby the stress waves in the tool generate a movement perpendicular to the surface of the tool, which movement is transmitted to the bearing bushing, causing plastic deformation to the bearing bushing, and the bearing bushing to be locked in place in the bearing space.

The breaking device according to the invention is characterized in that a clearance fit is arranged between the outer diameter of the bearing bushing and the diameter of the bearing space; that the bearing bushing is of deformable bearing material; that the bearing bushing is prevented in the axial direction from getting out of the bearing space after the mounting; and that the bearing bushing is locked in place in the bearing space during the use of the breaking device when the stress waves in the tool and the movement in the direction of the perpendicular of the tool surface due to the waves have caused the bearing bushing to be deformed against the bearing space.

The tool bushing according to the invention is characterized in that there is a clearance between the outer diameter of the bearing bushing and the bearing space, whereby the bearing bushing is movable in the axial direction against the shoulder and away from it without the bushing frame preventing it; that the tool bushing comprises at least one locking means with which the bearing bushing is prevented in the axial direction from getting out of the bushing frame; and that the bearing bushing is of deformable material, whereby it is arranged, during the use of the breaking device, to be deformed and to lock immovably in the bearing space.

An idea of the invention is that the breaking device tool is arranged through at least one bearing bushing, which fits the tool with a bearing in such a way that the tool can move in the axial direction relative to the frame of the breaking device. The bearing bushing is an elongated piece made of slide bearing material and arranged in the bearing space. A clearance fit is arranged between the outer diameter of the bearing bushing and the bearing space to facilitate the mounting of the bearing bushing. During the use, the bearing bushing is arranged to be subjected to stress waves of the compression stress pulses traveling in the tool, whereby the bearing bushing is arranged to be deformed by the effect of the stress waves. The periphery of the bearing bushing is enlarged in the direction of the periphery and deformed. The enlargement of the bearing bushing periphery results in compression stress between the bearing bushing and the bearing space, which locks the bushing to be immovable. Thus, in the solution according to the invention, the stress waves generated by a percussion device have two tasks: primarily they contribute to the breaking of the material to be treated, but they also cause the bearing bushing of the tool to be actually attached to its place in the bearing space.

An advantage of the invention is that the bearing bushing can be easily inserted in the axial direction to its place in the bearing space, since there is a clearance fit between the bearing space and the bearing bushing. No special pressing tools or the like are required for the mounting, but the bearing bushing can be inserted into the bearing space with manual force. Further, the bearing bushing is a simple utility item the manufacturing costs of which are small.

The idea of an embodiment of the invention is that the bearing bushing is prevented in the axial direction from getting out of the bearing space by means of one or more prelocking members. The prelocking member keeps the bearing bushing temporarily in place until the bearing bushing is deformed and actually attached to the bearing space.

The idea of an embodiment of the invention is that at least one bearing space is positioned at the lower end of the breaking device on the side of the tool in such a way that the bearing space is open downwards in the axial direction. Thus, the bearing bushing is insertable in the axial direction from below to its place in the bearing space without having to disassemble the lower frame of the breaking device. For changing, only the tool needs to be detached. An advantage of this embodiment is that it is quick and simple to change the bearing bushing. Further, since there is no need to disassemble structures of the breaking device, the changing may also take place in dirty working site conditions. As it is possible to change the bearing bushing in the working site, the interruption in the use of the breaking device can be as short as possible.

The idea of an embodiment of the invention is that the breaking device comprises a tool bushing comprising a bushing frame the inner circle of which forms a bearing space for the bearing bushing. The bushing frame may be immovably attached to the frame of the breaking device by means of one or more locking means. The bearing bushing is arranged to be deformed during the operation of the breaking device in such a way that it is pressed against the inner periphery of the bushing frame in the radial direction. The strength of the bushing frame is dimensioned to be greater than that of the bearing bushing so that substantially only the bearing bushing is deformed by the effect of stress waves. An advantage of this embodiment is that the bushing frame and the bearing space in it may be detached and changed, if required. Further, the tool bushings of the present breaking devices already in use may be replaced with tool bushings according to this embodiment, after which it will be easier to change the bearing bushings in the future.

The idea of an embodiment of the invention is that the bearing space is formed directly in the frame of the breaking device. Thus, the bearing bushing is arranged to be deformed against the frame of the breaking device during the use of the device. An advantage of this embodiment is that the breaking device does not need a separate bushing frame to form a bearing space. Thus, the diameter of the hole to be made around the tool in the breaking device frame may be smaller than when a separate detachable bushing frame is used, which reduces the manufacturing costs. In addition, there is no need to manufacture a bushing frame. Furthermore, the bearing space formed in the breaking device frame is particularly firm, whereby it can well receive the compression stress of the bearing bushing deformed during the use.

The idea of an embodiment of the invention is that the bearing bushing is of bearing bronze. Bearing bronze suits well to be used as the slide bearing of a breaking device tool, because it is deformed relatively easily due to the effect of stress waves, still having sufficient yield strength so that deformation causes compression stress in it, which keeps the bearing bushing in place in the bearing space due to the friction between the bearing bushing and the bearing space. Further, an advantage of bearing bronze is that it endures also short-term dry use without getting damaged when, for some reason or other, there is no lubricant film between the bearing bushing and the tool.

The idea of an embodiment of the invention is that the wall thickness of the bearing bushing is between 8 and 12 mm. Thus, the bearing bushing is sufficiently firm, so that sufficient compression stress is generated in it as a result of radial deformation. If the bearing bushing is not sufficiently firm, it does not stay properly in place in the bearing space. On the other hand, the wall thickness of the bearing bushing may not be so great that stress waves are not sufficient to generate deformation.

The idea of an embodiment of the invention is that the bearing bushing is prevented, by means of one or more prelocking member of light material, from getting out of the bearing space. An advantage of a lightweight prelocking member is that it is not subjected to such great acceleration forces during the operation of the percussion device as would a piece manufactured of denser material. The density of the prelocking member may be clearly smaller than that of the frame material. The density of the prelocking member material may be below 3 000 kg/m$^3$, whereas the density of the frame that is typically steel is about 8 0000 kg/m$^3$. Thus, the prelocking member may be manufactured of, for example, plastic material or reinforced plastic that has been reinforced with carbon, aramid or glass fibres or the like fibres. Further, the prelocking member may be manufactured of light metal, such as aluminum alloy. Furthermore, it may be manufactured of fibre material or even rubber. A prelocking member manufactured of light material does not, due to vibration, deform the locking surface made for it, such as a locking groove, locking opening or the like, because the acceleration forces directed at the prelocking member are relatively small. On the other hand, a prelocking member manufactured of less dense material is usually softer than a locking surface manufactured of denser material. A prelocking member manufactured of less dense material than the locking surface may wear during the use due to vibration, but this has no significance because the purpose of the prelocking member is to keep the bearing bushing in the bearing space only until some stress compression pulses have been given to the tool by the percussion device and until the stress waves in the tool have deformed the bearing bushing in such a way that it is firmly pressed into the bearing space.

The idea of an embodiment of the invention is that the prelocking member is a ring manufactured of plastic material, arranged in a groove on the periphery of the bearing space. It is simple and quick to arrange such a locking ring in place. Further, it is easy to manufacture inexpensive high-quality locking members of plastic material.

BRIEF DESCRIPTION OF THE FIGURES

Some embodiments of the invention will be described in more detail in the attached drawings, in which.

For the sake of clarity, embodiments of the invention are shown simplified in the figures. Similar parts are indicated with the same reference numerals.

DETAILED DESCRIPTION OF EMBODIMENTS OF THE INVENTION

Figure 1:
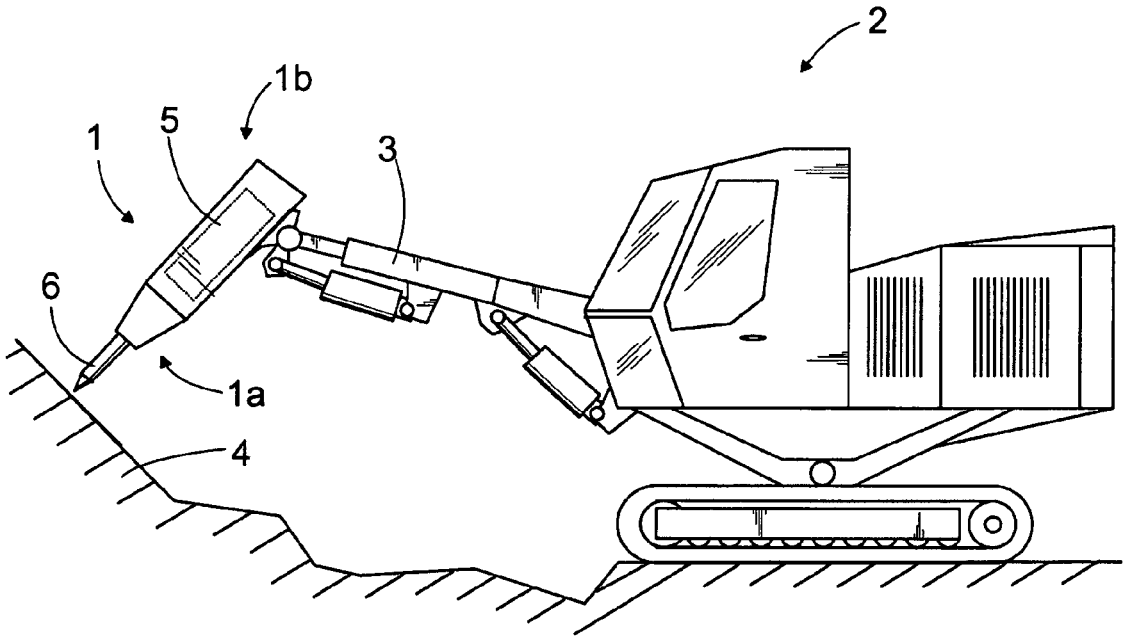
FIG. 1 shows schematically a side view of a breaking hammer arranged in the boom of an excavator.

In FIG. 1, a breaking hammer 1 is arranged on a boom 3 in an excavator 2. The breaking hammer 1 may be a hydraulic, pneumatic or electric device. The breaking device 1 is pressed by means of the boom 3 against material 4 to be broken at the same time as compression stress pulses may be given to a tool 6 connected to the hammer with a percussion device 5 in the hammer, and the tool 6 transmits the stress pulses to the material to be broken. The percussion device 5 usually comprises a reciprocating percussion piston striking a percussion surface at the upper end of the tool 6. In some cases, the percussion element may be an element other than a reciprocating percussion piston. Further, there may be a protective casing around the breaking hammer 1, protecting it against damages and impurities.

It can be noted that in this application the lower part 1*a* of the breaking hammer refers to the end on the side of the tool 6, while the upper part 1*b* of the breaking hammer refers to the end by which the breaking hammer 1 is attachable to the boom 3 or the like. Further, the breaking hammer 1 may be arranged in any movable basic machine or, for instance, on a boom attached to a fixed base, such as a rock crusher.

Figure 2:
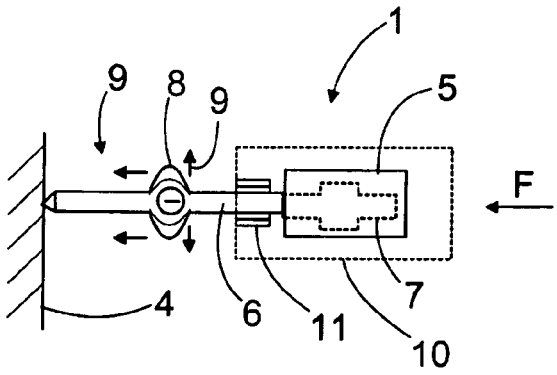
FIG. 2 shows schematically generation of a compression stress pulse in a tool that transmits the generated stress waves to the material to be broken.

FIG. 2 shows a very simplified operating principle of a breaking device. A percussion element 7 of the percussion device 5 generates in the tool 6 compression stress (−), which propagates in the tool 6 as stress waves. When a stress wave has reached the outermost end of the tool 6, part of it may move on to the material 4 to be broken, and part may return as a reflected wave back towards the percussion device 5. Traveling in the tool 6, the stress wave 6 generates a sudden small bulge 8 in the tool 6, in other words there is a sharp hammering movement 9 in the direction of the perpendicular of the tool surface in the tool 6.

Further, it can be seen from FIG. 2 that the tool 6 is bearing-mounted on a frame 10 in the breaking device 1 by means of one or more bearings 11. The bearing 11 is a slide bearing that is in contact with the tool 6. Thus, the radial hammering movement in the tool 6 is transmitted from the surface of the tool 6 also to the bearing 11, this feature being utilized in the actual attaching process of the bearing 11 in the invention. FIGS. 3 to 10 and the related description present embodiments and details of the bearing in greater detail.

Figure 3:
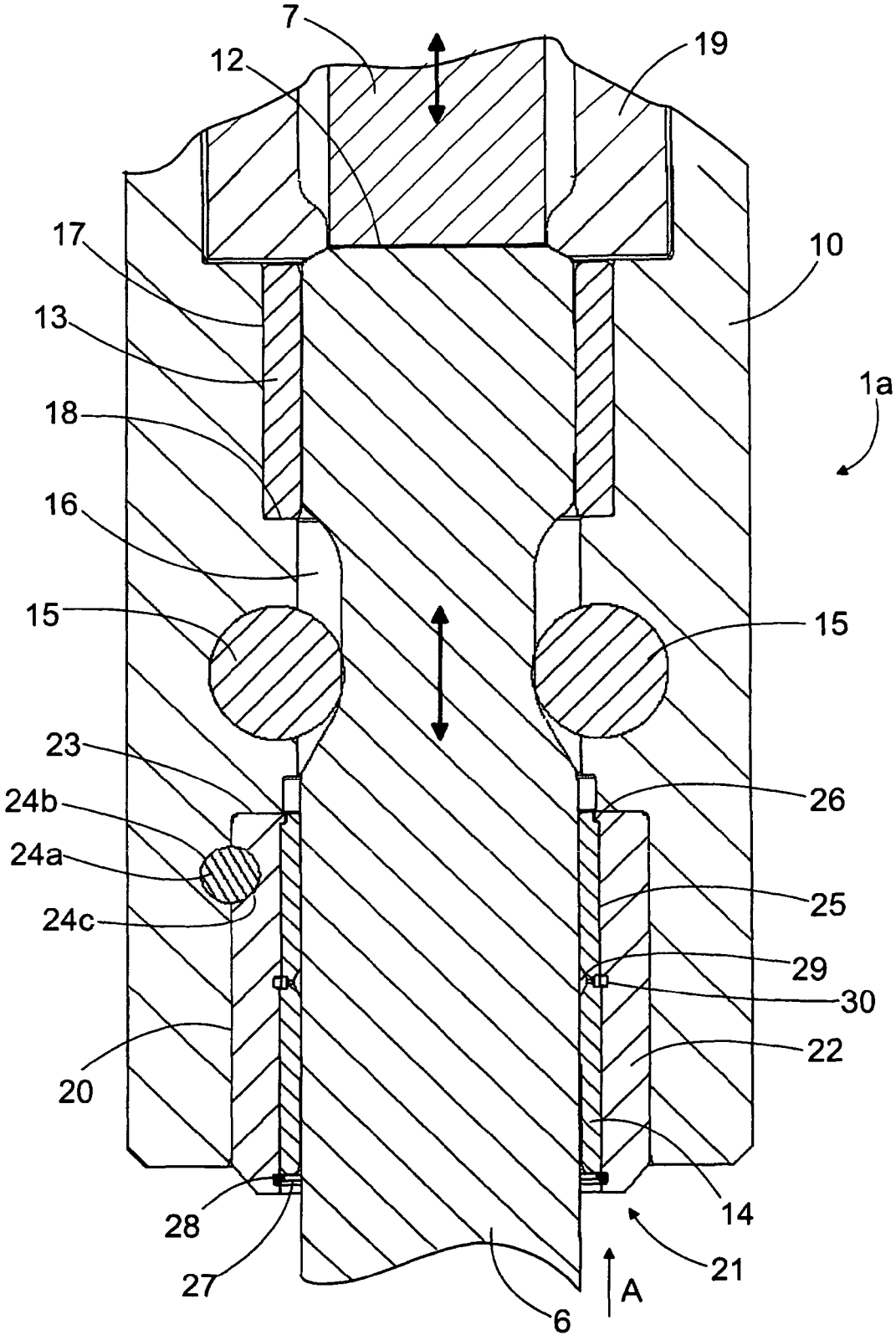
FIG. 3 shows schematically a cut-open part of the lower part of a breaking device.

FIG. 3 shows a part of the lower part 1*a* of the breaking hammer. The percussion element 7 may be a movable percussion piston that strikes a percussion surface 12 at the upper end of the tool 6. The tool 6 is arranged in the axial direction in the percussion element 7 and may be supported against the frame 10 by means of an upper bearing bushing 13 and a lower bearing bushing 14. The breaking hammer 1 may comprise retainer means allowing a predetermined axial movement for the tool 6 but preventing the tool 6 from getting completely out of the breaking device 1. Such retainer means may comprise one or more cross-direction retainer pins 15, for which a cross-direction opening is formed in the frame 10. Further, in order for the tool 6 to be able to move relative to the retainer pin 15, a thinned portion 16 may be formed in it at the point of the retainer pin 15. The upper bearing bushing 13 may be arranged in the upper bearing space 17 from the direction of the percussion element 7 when the frame of the breaking device has been disassembled. The upper bearing bushing 13 may be supported in the axial direction with a shoulder 18 and a counter-ring 19 or the like. The upper bearing bushing 13 may be manufactured of slide bearing metal, and it may contain lubricant channels along which lubricant may be conveyed to its slide surfaces.

The lower part of the frame 10 is provided with a space 20 open towards the outer surface of the frame 10, in which space 20 a tool bushing 21 is arranged from below, in the mounting direction A, the tool bushing 21 comprising a bushing frame 22 and a lower bearing bushing 14 arranged inside it. The tool bushing 21 is supported by its upper end against a shoulder 23 in the frame 10 and locked with one or more locking means, such as a cross-direction locking pin 24*a* and locking grooves 24*b* and 24*c* in such a way that it cannot get out of the space 20. The inner periphery of the bushing frame 22 forms a bearing space 25, into which the bearing bushing 14 is inserted. The end of the bushing frame 22 on the side of the percussion element may comprise a shoulder 26, against which the bearing bushing 14 may be inserted. Alternatively, the movement of the bearing bushing 14 in the axial direction may be prevented in such a way that the shoulder 23 in the frame 10 extends to the portion of the bearing bushing 14 as well. In the portion of the opposite end of the bushing frame 22, there may be a groove 27, which may be provided with a prelocking member 28, such as a ring made of plastic material. The purpose of the prelocking member 28 is to prevent the bearing bushing 14 from getting out of the bearing space 25 after the mounting and before the bearing bushing 14 has been attached to the bearing space 25 as a result of the deformation. Alternatively, the prelocking member 28 may be a cross-direction pin or another member suitable for the purpose. When the lower bearing bushing 14 has worn out, it may be replaced through the lower part of the breaking hammer without having to disassemble the lower part of the frame 10, or without even having to detach the tool bushing 21.

It can be seen from FIG. 3 that the bearing bushing 14 may be provided with one or more lubricant channels 29, along which lubricant may be conveyed to its slide surfaces. Correspondingly, the bushing frame 22 may comprise channels 30, as may the frame 10, for conveying lubricant to the bearing bushing 14.

Figure 4:
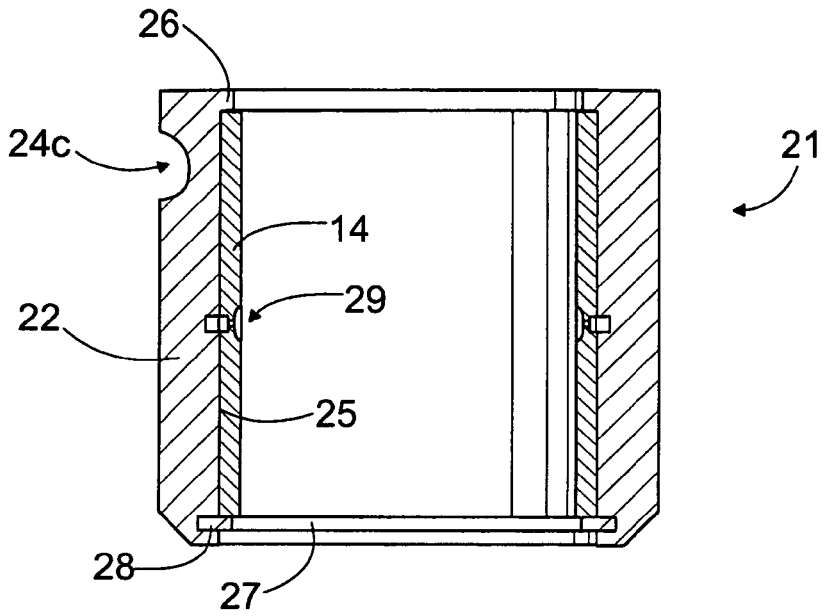
FIG. 4 shows schematically a side view of a cut-open tool bushing.
Figure 5:
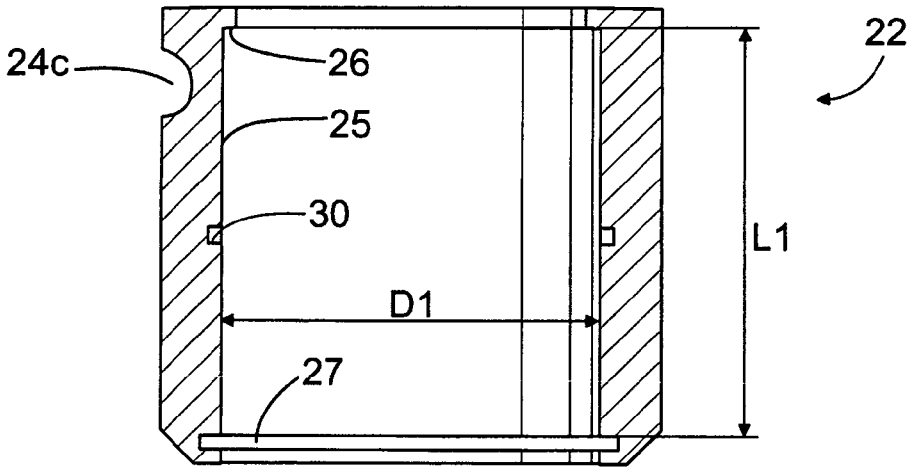
FIG. 5 shows schematically a side view of the cut-open bushing frame of the tool bushing according to FIG. 4.
Figure 6:
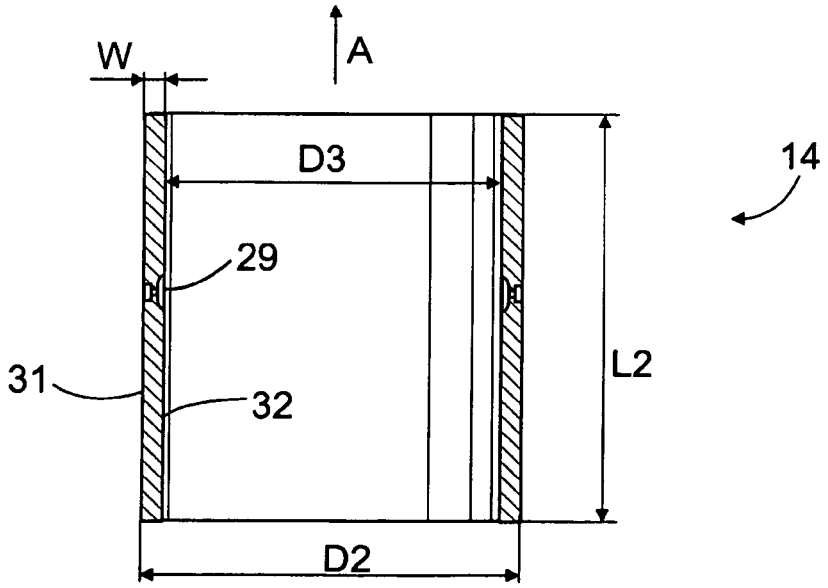
FIG. 6 shows schematically a side view of the cut-open bearing bushing of the tool bushing according to FIG. 4.

FIG. 4 shows the assembled tool bushing 21. FIG. 5 shows the bushing frame 22 and the diameter D1 of the bearing space 25. FIG. 6, in turn, shows the bearing bushing 14 and its outer diameter D2. In order to insert the bearing bushing 14 into the bearing space 25 without difficulty in the mounting direction A, the diameter D1 has been dimensioned greater than the diameter D2, in other words there is a small clearance between the bearing bushing 14 and the bearing space 25. The components arranged within each other have thus a clearance fit. Further, the distance between the shoulder 26 and the groove 27 in the bushing frame 22, i.e. the length L1 of the bearing space 25, is greater than or equal to the length L2 of the bearing bushing 14 in order for the bearing bushing 14 to be arrangeable inside the bushing frame 22. FIG. 6 further shows the outer periphery 31 of the bearing bushing 14, serving as the attachment surface against the bearing space 25, and the inner periphery 32 of the bearing bushing 14, serving as the slide surface against the tool 6. Further, FIG. 6 indicates the wall thickness W of the bearing bushing 14, which may be between 8 to 12 mm. Thus, the bearing bushing 14 is sufficiently firm so that required compression stress can be generated in it as a result of radial deformation. If the bearing bushing 14 is not sufficiently firm, it does not stay properly in place in the bearing space 25. On the other hand, the wall thickness W of the bearing bushing 14 may not be so great that the stress waves 9 are not capable to generate radial deformation in the bearing bushing. Furthermore, FIG. 6 indicates the inner diameter D3 of the bearing bushing 14, dimensioned greater than the outer diameter of the tool 6 in order for the slide bearing to function in general.

Figure 7:
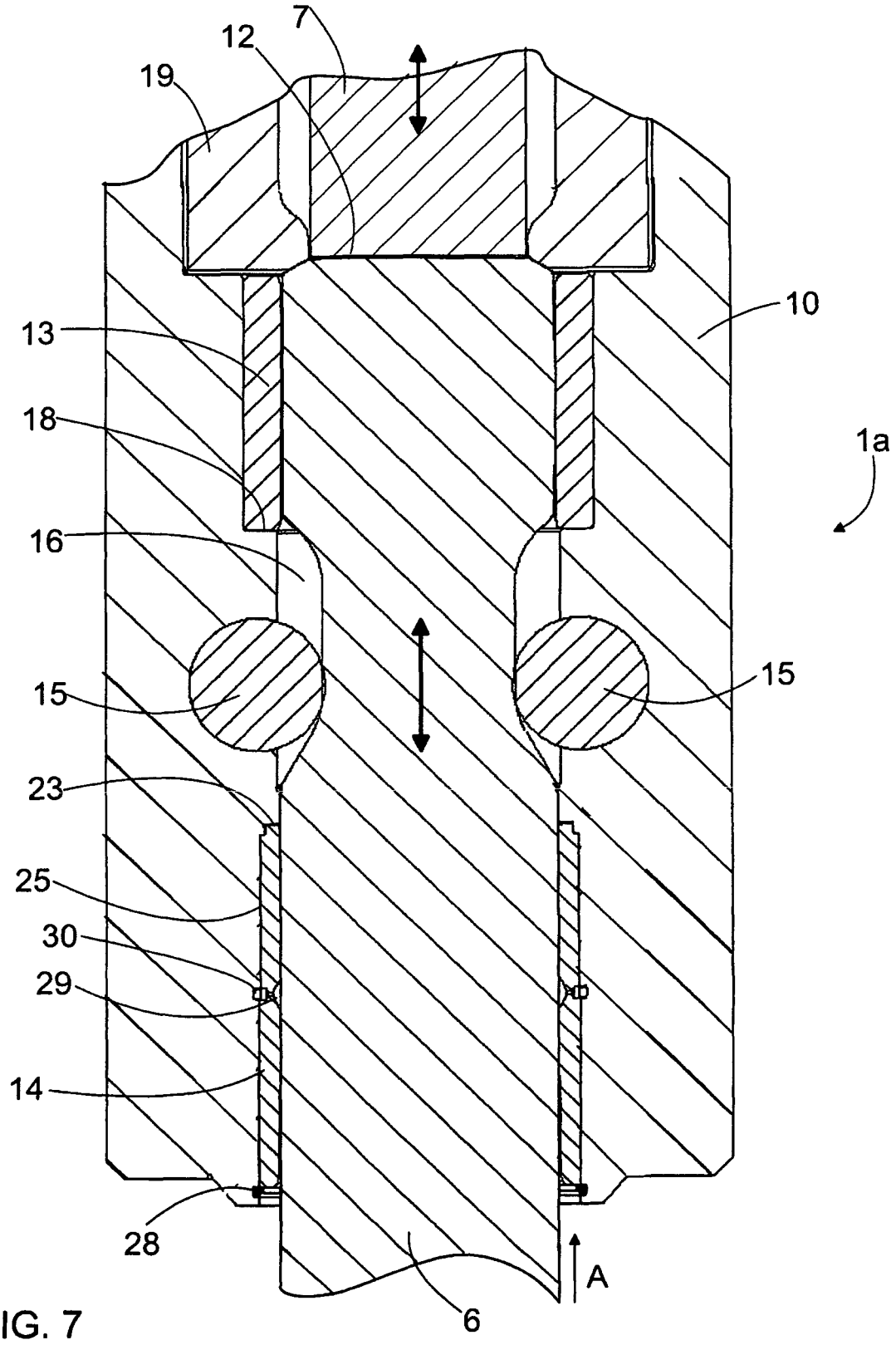
FIG. 7 shows schematically an open-cut part of the lower part of another breaking hammer.

FIG. 7 shows an alternative structure of the lower part 1*a* of the breaking hammer, in which, deviating from FIG. 3, there is no bushing frame 22 but the lower bearing bushing 14 is arranged in the bearing space 25 formed in the lower part of the frame 10. The lower part of the bearing space 25 may extend as far as to the outer surface of the lower part of the frame 10, whereby the bearing bushing 14 may be pushed in the mounting direction A from below to its place in the bearing space 25 without having to disassemble the frame 10. The bearing bushing 14 may be supported by its upper end against the shoulder 23 formed in the frame 10. By its lower end, the bearing bushing 14 may be supported with a suitable prelocking member 28 at least until it has been deformed in the radial direction against the bearing space 25 and locked in place.

Figure 8:
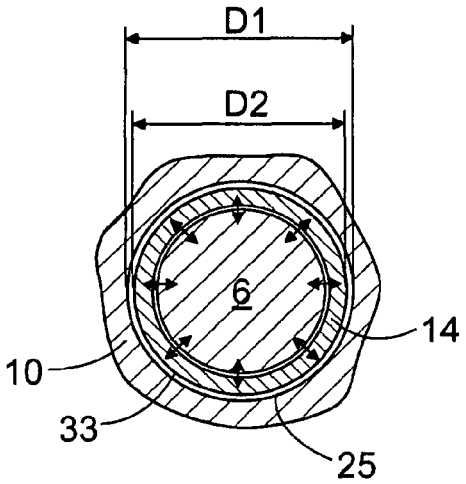
FIG. 8 shows schematically a cross-section of the bearing of a tool according to the invention, seen from the longitudinal direction of the tool, before the bearing bushing has been deformed.
Figure 9:
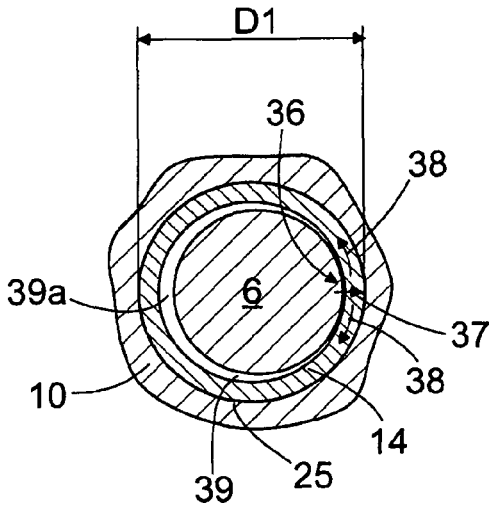
FIG. 9 shows schematically a cross-section of the bearing of a tool according to the invention, seen from the longitudinal direction of the tool, after the bearing bushing has been deformed by the effect of stress waves.

FIGS. 8 and 9 illustrate how the bearing bushing 14 is attached to the bearing space 25. The stress waves 9 traveling in the tool 6 generate on the tool surface a movement in the direction of its perpendicular, the movement being transmitted to the bearing bushing 14. This small hammering movement is illustrated with arrows in FIG. 8. After the mounting, there is a small clearance 33 between the bearing bushing 14 and the bearing space 25. The hammering movement due to the stress waves shapes the bearing bushing 14 and causes the bearing bushing 14 to expand, whereby its outer periphery is pressed against the bearing space 25, and the clearance 33 disappears.

It is seen from FIG. 9 that during the use the tool 6 is supported, due to clearances 39 between the tool 6 and the bearing bushing 14, against one support point 36 of the side of the bearing bushing 14. In practice, the tool 6 becomes thus positioned eccentrically inside the bearing bushing 14. Due to this, during one stress wave, hammering movement is transmitted to the bearing bushing 14 essentially only at the support point 36. As seen from FIG. 9, for example the opposite side of the support point 36 has a maximum clearance 39*a*, and the small bulge on the surface of the tool 6 is not capable of affecting the bearing bushing 14. However, the position of the tool 6 inside the bearing bushing 14 changes continuously during the use of the breaking hammer, so that forces which deform are directed at different points on the periphery of the bearing bushing 14. When the support point 36 is subjected to a radial force 37 caused by a stress wave and shown in FIG. 9, the bearing bushing 14 is pressed between the tool 6 and the bearing housing 25, due to which the periphery of the bearing bushing 14 tends to stretch in the way indicated with arrows 38. When the periphery of the bearing bushing 14 stretches, it expands and causes radial deformation of the whole bushing. The diameter of the bearing bushing 14 enlarges permanently, and the bushing is firmly pressed against the bearing housing 25.

The bearing space 25 may be of steel or corresponding material that is stronger than the bearing material and is capable of receiving the compression stress caused by the expansion of the bearing bushing 14 without the bearing space 25 being essentially deformed. The bearing bushing 14 may be manufactured of suitable bearing metal, such as bearing bronze. Alternatively, the bearing bushing 14 may be manufactured of any deformable slide bearing material, even plastic material or the like.

Figure 10:
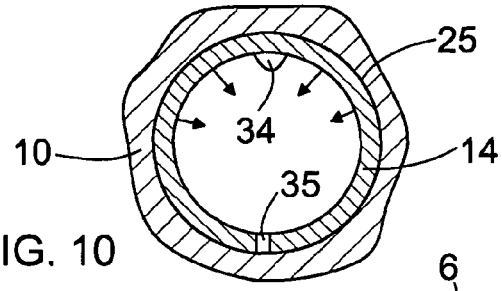
FIG. 10 shows schematically a cross-section indicating alternative ways to remove the bearing bushing deformed into the bearing housing.

FIG. 10 illustrates two alternative ways to remove the bearing bushing 14 deformed by the stress waves 9 from the bearing space 25. Before removing the bearing bushing 14, the tool 6 is detached, and the prelocking member 28 is removed if it is still there after the use. Subsequently, one or more longitudinal welding beads 34 may be welded on the inner periphery of the bearing bushing 14, which causes the bearing bushing 14 to contract in such a way that it can be drawn out of the bearing space 25. One possibility is to cut in the bearing bushing 14 a longitudinal through-groove 35, in which case the bearing bushing 14 may be pressed into a smaller diameter and subsequently drawn out of the bearing space 25. The bearing bushing 14 can be removed with conventional tools in working site conditions.

It is also feasible to apply the solution according to the invention in connection with the upper bearing bushing 13 of the breaking hammer tool 6. In such a case, also the upper bearing bushing 13 is attached to its place in the upper bearing space 17 by using stress waves 9 traveling in the tool 6, which stress waves deform the bearing bushing 13 in the radial direction and cause it to be pressed firmly against the bearing space 17. The upper bearing bushing 13 may be supported against the bearing space 17 with one or more prelocking members 28, due to which it is not necessary to support it in the way shown in FIG. 3 by means of a shoulder 18 and a counter-ring 19.

Figure 11:
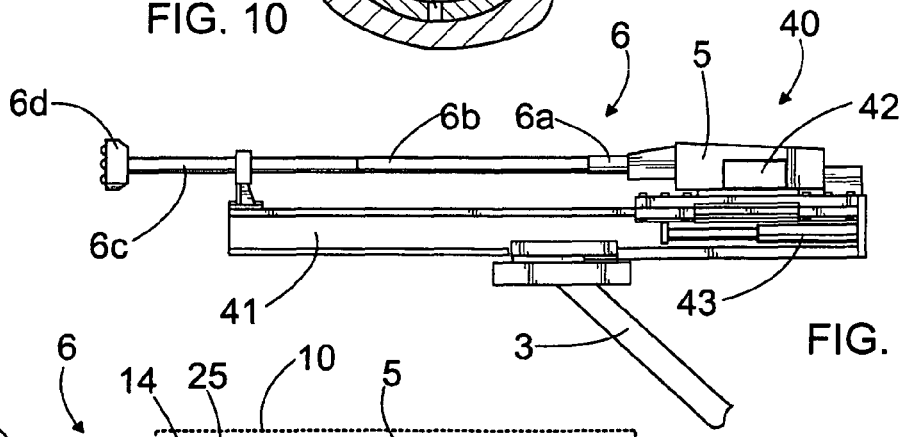
FIG. 11 shows schematically a side view of a rock drilling machine.

FIG. 11 shows a rock drilling machine 40, which may be arranged on a feed beam 41 on the boom 3 of the rock drilling rig. The rock drilling machine 40 is also some kind of a breaking device comprising a percussion device 5. By means of the percussion element 7 in the percussion device 5, a compression stress pulse may be generated in the tool 6 on an extension of the percussion device 5. The tool 6 may comprise a drill shank 6*a* and one or more extension rods 6*b* and 6*c*, and further, there may be a drill bit 6*d* at the outermost end of the tool. The rock drilling machine 40 may further comprise a rotating device 42, with which the tool 6 can be rotated around its longitudinal axis. Furthermore, the rock drilling machine 40 may be moved by means of a feed device 43, supported by the feed beam 41. In this application, the end of the rock drilling machine 40 on the side of the drill shank 6*a* may be called the lower part or the lower end.

Figure 12:
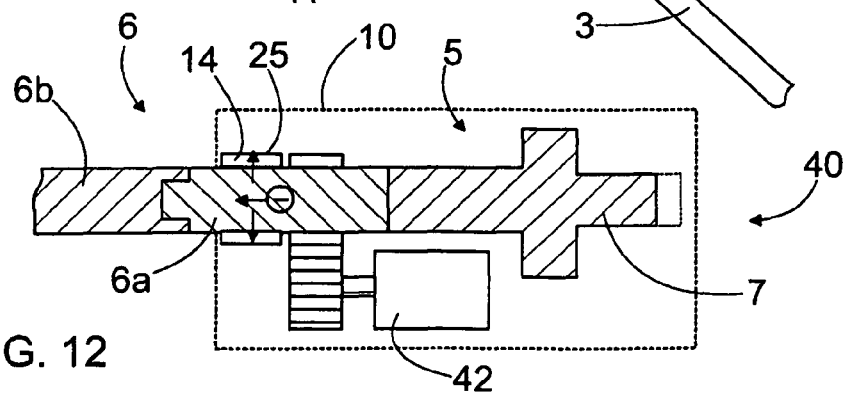
FIG. 12 shows schematically an open-cut structure of a rock drilling machine.

FIG. 12 shows the structure of the rock drilling machine 40. The drill shank 6*a* may be supported against the frame 10 with one or more bearing bushings 14 manufactured of slide bearing material. The bearing bushing 14 is arranged in the bearing space 25 that may be formed directly in the frame 10 of the rock drilling machine or in a separate piece attachable to and detachable from a space formed in the frame for this purpose. The bearing space 25 may be arranged at the lower end of the rock drilling machine 40, i.e. at the end on the side of the drill bit 6*a*, in such a way that the bearing bushing 14 may be inserted to its place without disassembling the frame 10. The preattachment of the bearing bushing 14 and the actual locking in place in the bearing space 25 may take place in the ways described earlier in this application. After the bearing bushing 14 has been mounted, the rotation is switched off until the impact pulses given with the percussion device have caused the bearing bushing 14 to be deformed and pressed into the bearing space 25. After this, the rotation may be switched on, and the normal drilling may be started.

In some cases, the features presented in this application may be used as such, irrespective of the other features. On the other hand, features described in this application may, if required, be combined to form different combinations.

The drawings and the related description are only intended to illustrate the idea of the invention. Details of the invention may vary within the scope of the claims.

What is claimed is:

1. A breaking device comprising:

a frame, a percussion device having a percussion element for generating compression stress pulses, a tool arranged on the extension of the percussion element and arranged to transmit the compression stress pulses to material to be broken as stress waves, and at least one bearing bushing arranged in a bearing space around the tool, which bearing bushing is of bearing material, whereby it is arranged to form a slide bearing for the tool moved in the axial direction, wherein an initial clearance space in the radial direction is arranged between the outermost diameter of the bearing bushing and the diameter of the bearing space, wherein the bearing bushing is of permanently deformable bearing material such that when deformed the material is permanently deformed, wherein the bearing bushing is prevented in the axial direction from getting out of the bearing space after the mounting, and wherein the bearing bushing is locked in place in the bearing space in both the axial and radial directions during the use of the breaking device when the stress waves in the tool and the movement in the direction of the perpendicular of the tool surface due to the waves have caused the bearing bushing to be enlarged in the direction of the periphery and radially deformed against the bearing space to lock the bushing immovably axially and radially in the bearing space.

2. A breaking device according to claim 1, wherein the bearing bushing is prevented in the axial direction from getting out of the bearing space after the mounting by means of at least one prelocking member.

3. A breaking device according to claim 1, wherein the bearing bushing is prevented in the axial direction from getting out of the bearing space after the mounting by means of at least one prelocking member, and the prelocking member is manufactured of light material, the density of which is below 3000 kg/m$^3$.

4. A breaking device according to claim 1, wherein the breaking device comprises a tool bushing that is a separate piece attachable to the frame of the breaking device, the tool bushing comprises an elongated bushing frame having an outer periphery and an inner periphery, and the inner periphery of the bushing frame serves as the bearing space, in which the bearing bushing is arranged.

5. A breaking device according to claim 1, wherein the bearing space is formed directly in the frame of the breaking device.

6. A breaking device according to claim 1, wherein the bearing bushing is manufactured of bearing bronze.

7. A breaking device according to claim 1, wherein the breaking device is a breaking hammer.

8. A breaking device according to claim 1, wherein the breaking device is a rock drilling machine.

9. A breaking device according to claim 1, wherein a wall thickness of the bearing bushing is 8 to 12 mm.

10. A breaking device according to claim 1, wherein a periphery of the bearing bushing is non-slotted, or alternatively, the bearing bushing is solid.

11. A breaking device according to claim 1, wherein the bearing bushing is solid.

12. A breaking device according to claim 1, wherein the permanently deformed bearing bushing of the tool is attached to its place in the bearing space.

13. A breaking device comprising:

a frame, a percussion device having a percussion element for generating compression stress pulses, a tool arranged on the extension of the percussion element and arranged to transmit the compression stress pulses to material to be broken as stress waves, and at least one bearing bushing arranged in a bearing space around the tool, which bearing bushing is of bearing material, whereby it is arranged to form a slide bearing for the tool moved in the axial direction, wherein a clearance space in the radial direction is arranged between the outermost diameter of the bearing bushing and the diameter of the bearing space, wherein the bearing bushing is of deformable metallic bearing material, wherein the bearing bushing is prevented in the axial direction from getting out of the bearing space after the mounting, and wherein the bearing bushing is locked in place in the bearing space in both the axial and radial directions during the use of the breaking device when the stress waves in the tool and the movement in the direction of the perpendicular of the tool surface due to the waves have caused the bearing bushing to be enlarged in the direction of the periphery and radially deformed against the bearing space to lock the bushing immovably axially and radially in the bearing space.

14. A breaking device according to claim 13, wherein a wall thickness of the bearing bushing is 8 to 12 mm.

15. A breaking device according to claim 13, wherein a periphery of the bearing bushing is non-slotted, or alternatively, the bearing bushing is solid.

16. A breaking device according to claim 13, wherein the bearing bushing is solid.

17. A breaking device comprising:

a frame, a percussion device having a percussion element for generating compression stress pulses, a tool arranged on the extension of the percussion element and arranged to transmit the compression stress pulses to material to be broken as stress waves, and at least one bearing bushing arranged in a bearing space around the tool, which bearing bushing is of bearing material, whereby it is arranged to form a slide bearing for the tool moved in the axial direction, wherein an initial clearance space in the radial direction is arranged between the outermost diameter of the bearing bushing and the diameter of the bearing space, wherein the bearing bushing is of deformable rigid bearing material, wherein the bearing bushing is prevented in the axial direction from getting out of the bearing space after the mounting, and wherein the bearing bushing is locked in place in the bearing space in both the axial and radial directions during the use of the breaking device when the stress waves in the tool and the movement in the direction of the perpendicular of the tool surface due to the waves have caused the bearing bushing to be enlarged in the direction of the periphery and radially deformed against the bearing space to lock the bushing immovably axially and radially in the bearing space.

18. A breaking device according to claim 17, wherein a wall thickness of the bearing bushing is 8 to 12 mm.

19. A breaking device according to claim 17, wherein a periphery of the bearing bushing is non-slotted, or alternatively, the bearing bushing is solid.

20. A breaking device according to claim 17, wherein the bearing bushing is solid.

21. A breaking device comprising:

a frame, a percussion device having a percussion element for generating compression stress pulses, a tool arranged on the extension of the percussion element and arranged to transmit the compression stress pulses to material to be broken as stress waves, and at least one bearing bushing arranged in a bearing space around the tool, which bearing bushing is of bearing material, whereby it is arranged to form a slide bearing for the tool moved in the axial direction, wherein an initial clearance space in the radial direction is arranged between the outermost diameter of the bearing bushing and the diameter of the bearing space, wherein the bearing bushing is prevented in the axial direction from getting out of the bearing space after the mounting, wherein the bearing bushing is of permanently deformable bearing material, and wherein the bearing bushing has been enlarged in the direction of the periphery and radially deformed, by the stress waves in the tool and the movement in the direction of the perpendicular of the tool surface due to the waves, to press against the bearing space to lock the bushing immovably axially and radially in the bearing space.

22. A breaking device according to claim 21, wherein the initial clearance space disappears by the enlarged bearing bushing pressed against the bearing space.

* * * * *